US006446376B1

(12) United States Patent
Chan

(10) Patent No.: US 6,446,376 B1
(45) Date of Patent: Sep. 10, 2002

(54) PHOTO DISPLAY UNIT

(75) Inventor: Sik-Leung Chan, Tsuen Wan (HK)

(73) Assignee: C. C. & L Company Limited, Tsuen Wan (HK)

( * ) Notice: Subject to any disclaimer, the term of this patent is extended or adjusted under 35 U.S.C. 154(b) by 79 days.

(21) Appl. No.: 09/630,092

(22) Filed: Aug. 1, 2000

(51) Int. Cl.[7] ..... A47G 1/06

(52) U.S. Cl. ..... 40/721; 40/376; 40/388; 40/389; 40/492; 40/533; 40/723

(58) Field of Search ..... 40/376, 388, 390, 40/661.06, 661.07, 492, 530, 533, 721, 723, 729, 733

(56) References Cited

U.S. PATENT DOCUMENTS 306,291 A * 10/1884 Smyth ..... 40/376
2,080,995 A * 5/1937 Baker et al. ..... 40/336
2,612,168 A * 9/1952 Stark ..... 40/376
2,994,298 A * 8/1961 Thomas ..... 118/500
3,265,453 A * 8/1966 Seide ..... 312/9.59
3,641,690 A * 2/1972 Ehrensaal ..... 40/376
3,858,340 A * 1/1975 Melanson ..... 40/533
5,101,972 A * 4/1992 Hunt et al. ..... 206/307
6,238,022 B1 * 5/2001 Chan ..... 312/9.11

* cited by examiner

*Primary Examiner*—Jack Lavinder
*Assistant Examiner*—Andrea Chop
(74) *Attorney, Agent, or Firm*—Alix, Yale & Ristas, LLP

(57) ABSTRACT

A photo display unit (100) comprising a casing (10) having an open side (12), a lid (20) pivotably connected to the casing (10) for closing and revealing the open side (12), and a stack of frames (30) contained within the casing (10) for holding respective photographs, pictures or the like. Each frame (30) is individually pivotable along its plane into and out of the casing (10) through the open side (12) between a storage position and a display position. A movable selector (70) is provided at the lid (20) for selectively engaging any one of the frames (30) and enabling the lid (20) to pivot the selected frame (30) out of the casing (10).

14 Claims, 4 Drawing Sheets

PHOTO DISPLAY UNIT

The present invention relates to a display unit for holding and displaying photographs, pictures, postcards or the like.

SUMMARY OF THE INVENTION

According to the invention, there is provided a photo display unit comprising a casing having an open side, a cover pivotably connected to the casing for closing and revealing the open side, a stack of frames contained within the casing for holding respective photographs, pictures or the like, each said frame being individually pivotable along its plane into and out of the casing through the open side thereof between a storage position and a display position, and a movable selector provided at the cover for selectively engaging any one of the frames and enabling the cover to pivot the selected frame out of the casing.

Preferably, the cover is resiliently biassed by means of a spring towards a position revealing the open side of the casing.

More preferably, the cover is lockable by means of a latch in an alternative position closing the open side of the casing.

It is preferred that the cover and the frames are supported for pivotal movement about a common hinge axis.

In a specific construction, the cover is supported for pivotal movement by a hinge which is formed by an outer cylinder and an inner cylinder received co-axially within the outer cylinder for rotation relative thereto, one of said cylinders being connected with the casing and the other being connected with the cover.

More specifically, the hinge includes an internal torsional coil spring co-acting between the two cylinders to resiliently bias the cover towards a position revealing the open side of the casing.

More specifically, the frames are supported by the hinge for pivotal movement.

Further more specifically, the frames include respective rings, through which the hinge passes to support the frames.

In a preferred embodiment, the casing includes a second open side adjoining the first mentioned open side to give room to the frames for pivoting into and out of the casing.

More preferably, each frame has an open edge portion for the insertion of a photograph, picture or the like, said edge portion being accessible through the second open side of the casing.

It is preferred that each frame has a part for engagement by the selector, and the selector has a projection movable to reach behind the part of a selected frame for engagement therewith to pivot the selected frame out of the casing.

More preferably, the selector is arranged to have a series of stable positions corresponding to the positions of the frames in the casing, which are defined by an internal resilient clicking member.

In a specific construction, the selector is supported by the cover for rotation about an axis substantially perpendicular to the cover.

More specifically, the cover is formed with a side slot, through which the selector is accessible for manual rotation.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
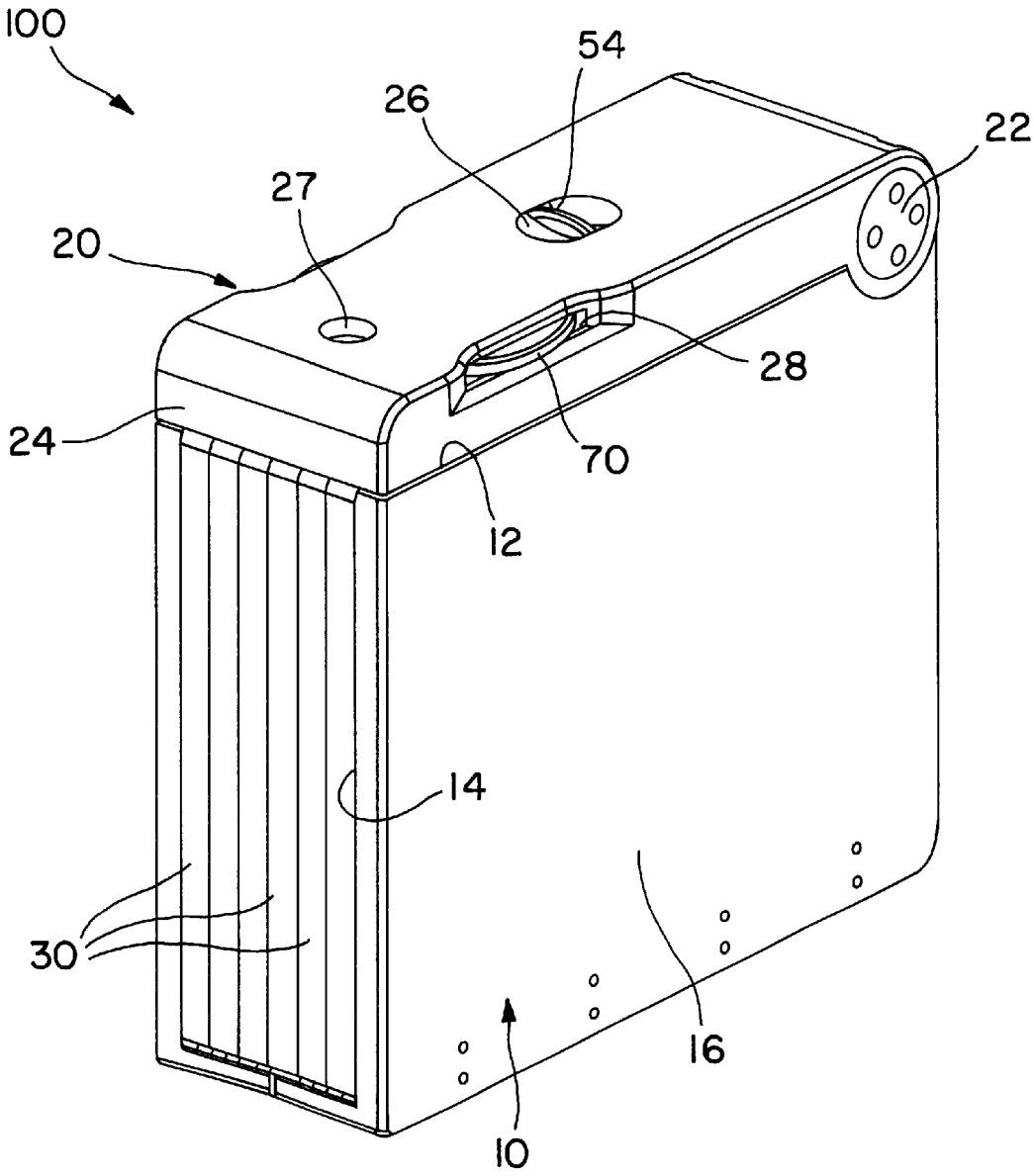
FIG. 1 is a front perspective view of an embodiment of a photo display unit in accordance with the invention, said unit having a lid and a series of internal frames for holding photographs.
Figure 2:
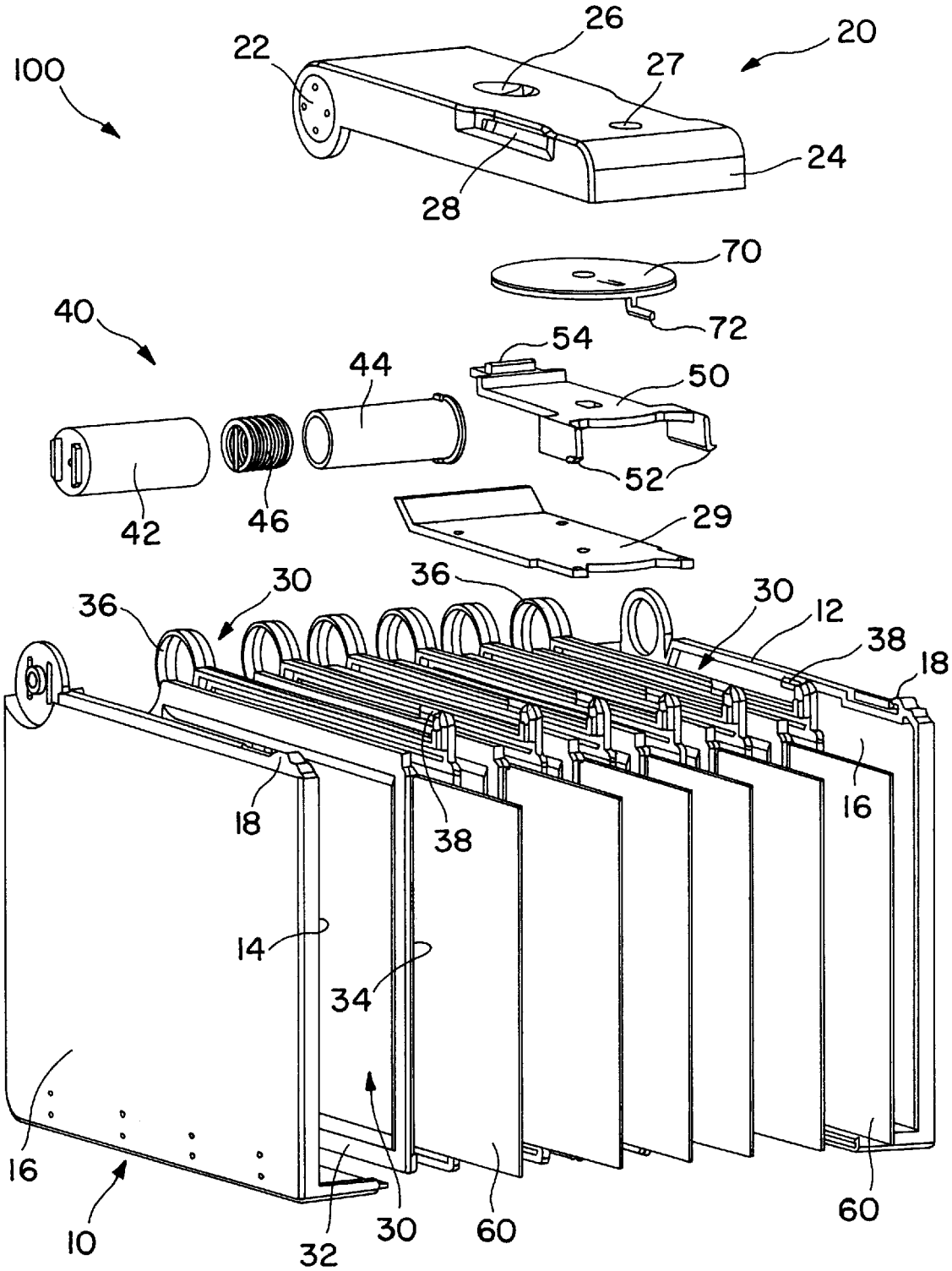
FIG. 2 is an exploded front perspective view of the photo display unit of FIG. 1.

Referring to the drawings, there is shown a photo display unit 100 embodying the invention, which unit 100 comprises a vertical rectangular box-like casing 10 having an oblong open top side 12, an oblong cover or lid 20 for closing and revealing the top side 12, and a vertical stack of six photo frames 30 contained within the casing 10. The casing 10 includes an oblong open front side 14 adjoining the top side 12 and a pair of vertical walls 16 forming opposite sides of the casing 10. The lid 20 is connected at its rear end 22 to the top rear corner of the casing 10 by means of a horizontal hinge bar 40 which extends across the same corners of the walls 16.

The hinge bar 40 is formed by an outer cylinder 42 and a co-axial inner cylinder 44 which is received substantially fully within the outer cylinder 42 for rotation relative thereto, and includes an internal torsional coil spring 46 co-acting between the two cylinders 42 and 44. The outer cylinder 42 is connected at its outer end with the top rear corner the left casing wall 16, the inner cylinder 44 is connected at its outer end with the right side of the rear end 22 of the lid 20, such that the lid 20 is pivotable open (FIG. 4) and closed (FIG. 1) about the hinge bar 40 with respect to the casing 10.

Figure 4:
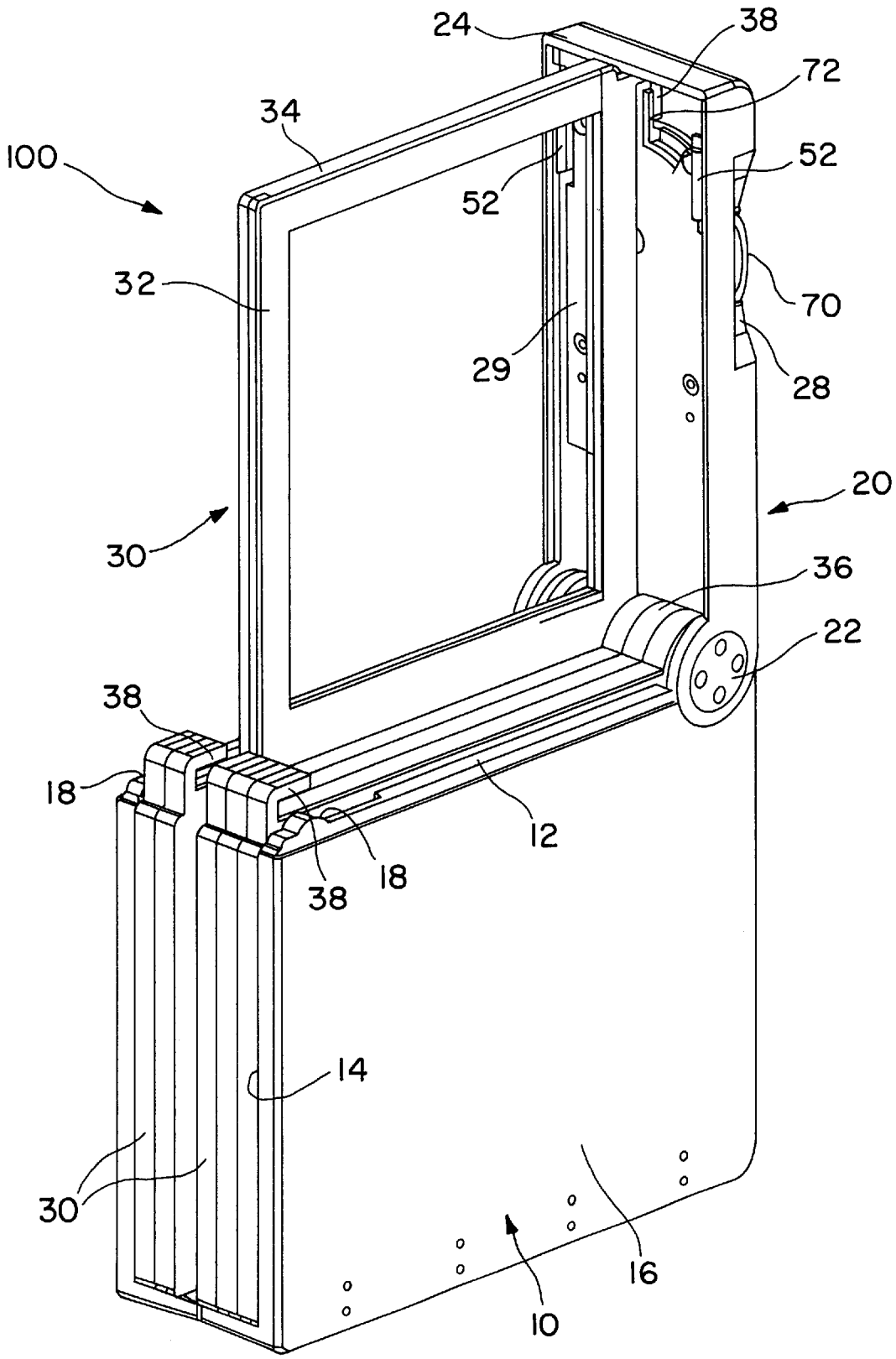
FIG. 4 is a front perspective view corresponding to FIG. 3, showing the lid fully opened to reveal the whole of the frame.

The spring 46 is pre-loaded to resiliently bias the lid 20 to open, which is openable through an angle of 900 to reach an upright position (FIG. 4). The space between the two cylinders 42 and 44 of the hinge bar 40 is filled with a viscous liquid, such as oil or resin, which serves to slow down the pivotal movement of the lid 20, such that the lid 20 will open in a gradual and steady action.

The lid 20 is hollow and is partially closed on its lower side by a plate 29. The lid 20 incorporates an internal spring-loaded latch 50 for locking the lid 20 closed, which is slidable back-and-forth to a limited extent relative to the lid 20. The latch 50 has, at its front end and on opposite sides thereof, a pair of forwardly pointing hooks 52 for engaging, under the action of the associated spring (not shown), with respective rearwardly facing recesses 18 formed on opposite casing walls 16. The latch 50 includes a knob 54 at its rear end, which is accessible through a small opening 26 on the upper side of the lid 20 for manually sliding the latch 50 backwards to release the latch 50 and hence the lid 20.

Each photo frame 30 has a flat rectangular double-walled body 32 including an open front edge portion 34 for the insertion (and subsequent removal) of a photograph 60, picture or the like. The edge portions 34 are readily accessible through the open front side 14 of the casing 10. The frame 30 includes an integral ring 36 at its top rear corner and an integral hook 38 at its top front corner pointing rearwards. The six frame bodies 32 are connected together by the hinge bar 40 passing through their rings 36, such that they are individually pivotable along its plane into and out of the casing 10 between a storage position (FIG. 1) and a display position (FIG. 4).

Figure 3:
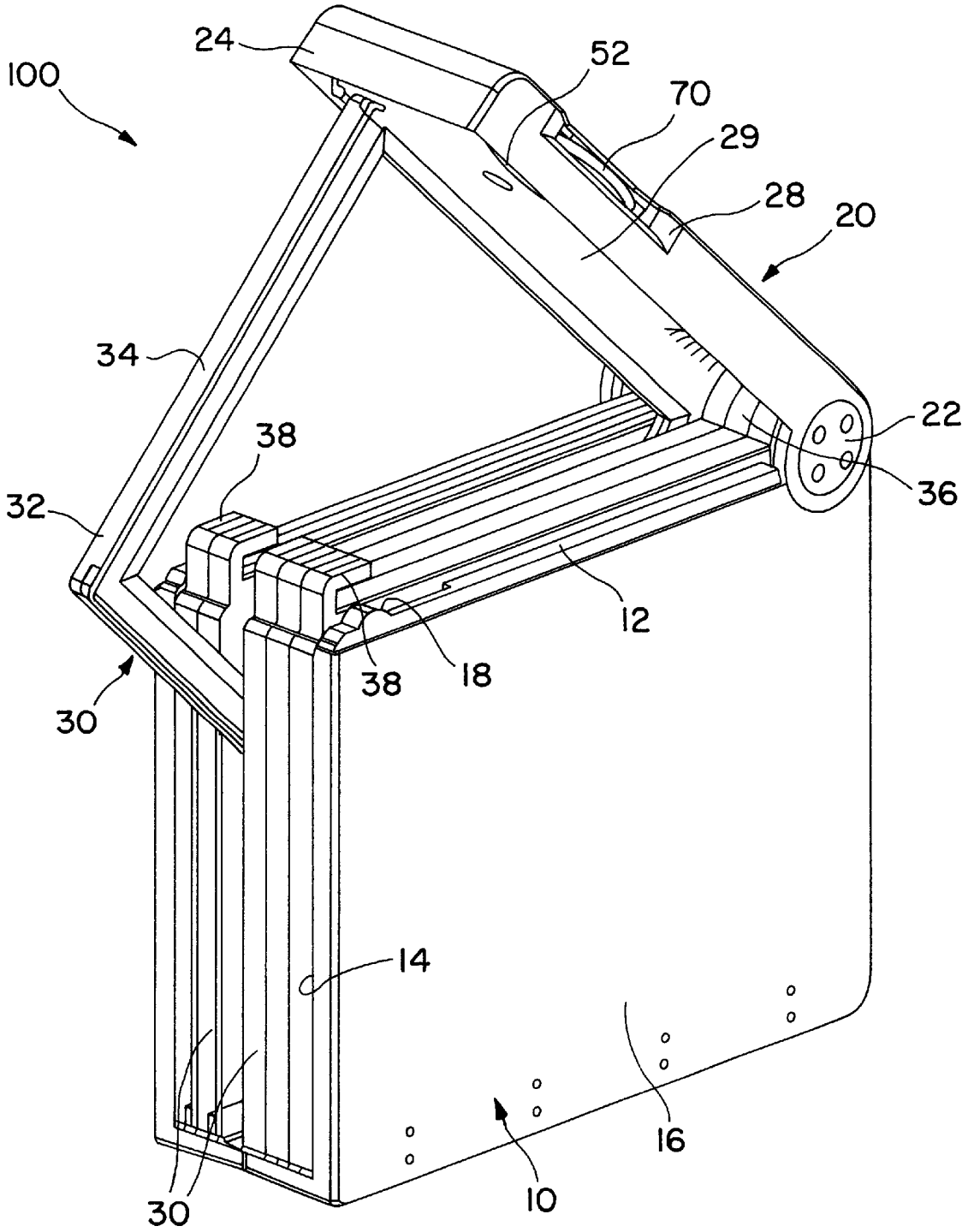
FIG. 3 is a front perspective view corresponding to FIG. 1, showing the lid halfway opened to pivot one of the frames.

The photo frames 30 are pivotable into and out of the casing 10 through the top side 12, with the adjoining front side 14 being also open to give room to the frames 30 for movement (FIG. 3). While they are within the casing 10, the frame bodies 32 together occupies substantially the entire interior of the casing 10, with their hooks 38 extending upwards into a front end 24 of the lid 20.

The lid 20 further incorporates a selector disc 70 for selecting and pivoting out any one of the photo frames 30. The disc 70 is supported by the lid 20 for rotation about an axis perpendicular to the lid 20, and is accessible for manual rotation through a pair of slots 28 formed on opposite sides of the lid 20. The disc 70 includes a lower integral finger 72 which projects forwards into the space immediately behind or underneath the hooks 38, while the lid 20 is closed and the photo frames 30 are within the casing 10.

The selector disc 70 is arranged to have a series of six stable angular positions corresponding to the positions of the photo frames 30 in the casing 10, which are defined by an internal resilient clicking member (not shown), such that the finger 72 is alignable with any one of the hooks 38. Such angular positions are indicated by corresponding numerals "1" to "6" printed on the upper side of the disc 70 for viewing through another small opening 27 on the upper side of the lid 20.

Upon release and thus upward pivotal movement of the lid 20, the selector finger 72 will engage the hook 38 of the selected photo frame 30 and pivot the frame 30 out of the casing 10 (FIG. 3) for displaying the relevant photograph (FIG. 4). As each frame 30 is open on both opposite sides, two photographs may be inserted in a back-to-back manner for display at the same time.

In order to retrieve another photo frame 30 for display, the lid 20 should first be closed manually to return the original frame 30 back into the casing 10. The selector disc 70 is then turned to the desired position, and the lid 20 is finally re-opened to extend the second frame 30.

It is clear that the photo display unit 100 can be used vertically as shown in the drawings, or alternatively in a horizontal manner such that the lid 20 may pivot open down onto a support surface.

The invention has been given by way of example only, and various modifications of and/or alterations to the described embodiment may be made by persons skilled in the art without departing from the scope of the invention as specified in the appended claims.

What is claimed is:

1. A photo display unit comprising a casing having an open side, a cover pivotably connected to the casing for closing and revealing the open side, a stack of frames contained within the casing for holding respective photographs, pictures or the like, each said frame being individually pivotable along its plane into and out of the casing through the open side thereof between a storage position and a display position, and a rotatable selector provided at the cover for selectively engaging any one of the frames and enabling the cover to pivot the selected frame out of the casing.

2. The photo display unit as claimed in claim 1, wherein the cover is resiliently biased by means of a spring towards a position revealing the open side of the casing.

3. The photo display unit as claimed in claim 2, wherein the cover is lockable by means of a latch in an alternative position closing the open side of the casing.

4. The photo display unit as claimed in claim 1, wherein the cover and the frames are supported for pivotal movement about a common hinge axis.

5. The photo display unit as claimed in claim 1, wherein the cover is supported for pivotal movement by a hinge which is formed by an outer cylinder and an inner cylinder, said inner cylinder being received co-axially within the outer cylinder for rotation relative to said outer cylinder, one of said cylinders being connected with the casing and the other of said cylinder being connected with the cover.

6. The photo display unit as claimed in claim 5, wherein the hinge includes an internal torsional coil spring co-acting between the two cylinders to resiliently bias the cover towards a position revealing the open side of the casing.

7. The photo display unit as claimed in claim 5, wherein the frames are supported by the hinge for pivotal movement.

8. The photo display unit as claimed in claim 7, wherein the frames include respective rings, through which the hinge passes to support the frames.

9. The photo display unit as claimed in claim 1, wherein the casing includes a second open side adjoining the first mentioned open side to give room to the frames for pivoting into and out of the casing.

10. The photo display unit as claimed in claim 9, wherein each frame has an open edge portion for the insertion of a photograph, picture or the like, said edge portion being accessible through the second open side of the casing.

11. The photo display unit as claimed in claim 1, wherein each frame has a part for engagement by the selector, and the selector has a projection movable to reach behind the part of a selected frame for engagement therewith to pivot the selected frame out of the casing.

12. The photo display unit as claimed in claim 11, wherein the selector is arranged to have a series of stable positions corresponding to the positions of the frames in the casing, which are defined by an internal resilient clicking member.

13. The photo display unit as claimed in claim 1, wherein the cover pivots about a first axis, the selector is supported by the cover for rotation about an axis of rotation, said axis of rotation being substantially perpendicular to the first axis.

14. The photo display unit as claimed in claim 13, wherein the cover is formed with a side slot, through which the selector is accessible for manual rotation.

* * * * *